US010450158B2

(12) United States Patent
Wahlberg, Jr. et al.

(10) Patent No.: US 10,450,158 B2
(45) Date of Patent: Oct. 22, 2019

(54) PIVOTING GRIPPER MANDREL

(71) Applicants: Andrew Frederick Wahlberg, Jr., Crown Point, IN (US); Anthony Alessandrini, Crown Point, IN (US)

(72) Inventors: Andrew Frederick Wahlberg, Jr., Crown Point, IN (US); Anthony Alessandrini, Crown Point, IN (US)

( * ) Notice: Subject to any disclaimer, the term of this patent is extended or adjusted under 35 U.S.C. 154(b) by 80 days.

(21) Appl. No.: 15/423,835

(22) Filed: Feb. 3, 2017

(65) Prior Publication Data

US 2018/0222710 A1 Aug. 9, 2018

Related U.S. Application Data

(60) Provisional application No. 62/338,302, filed on May 18, 2016.

(51) Int. Cl.

*B65H 19/28* (2006.01)
*B21C 47/30* (2006.01)
*B21C 47/32* (2006.01)

(52) U.S. Cl.

CPC ..... *B65H 19/28* (2013.01); *B21C 47/30* (2013.01); *B21C 47/323* (2013.01); *B65H 2301/414225* (2013.01); *B65H 2701/173* (2013.01)

(58) Field of Classification Search

CPC .... B65H 16/021; B65H 16/06; B65H 16/023; B65H 19/28; B65H 29/003; B65H 29/008; B65H 75/242; B65H 75/245; B65H 75/247; B65H 75/185; B21C 47/20; B21C 47/30; B21C 47/045; B21C 47/323; B21C 1/14

USPC ..... 242/571, 573.1, 573.4, 573.5, 573.8; 279/2.17

See application file for complete search history.

(56) References Cited

U.S. PATENT DOCUMENTS 1,259,163 A * 3/1918 Sundh ..... B65H 75/242 242/573.7
2,211,472 A * 8/1940 Klein ..... B21C 47/30 242/571.6
2,241,669 A * 5/1941 McConnell ..... B21C 47/30 242/573.7
2,591,730 A * 4/1952 Sendzimir ..... B21C 47/30 242/573.3
2,703,685 A * 3/1955 Stephan ..... B21C 47/30 242/573.8
2,920,837 A * 1/1960 Wingard ..... B21C 47/30 242/573.8
3,085,763 A * 4/1963 Floyd, Jr. ..... B65H 75/242 242/573.8
3,086,727 A * 4/1963 Tracy ..... B21C 47/30 242/573.8
3,116,891 A * 1/1964 Anderson ..... B65H 75/242 242/573.7
3,273,817 A * 9/1966 Damiron ..... B65H 75/243 242/571.2

(Continued)

FOREIGN PATENT DOCUMENTS

DE 4243434 A1 * 6/1994 ..... B21C 47/30
DE 10333004 A1 * 4/2004 ..... B21C 47/30

*Primary Examiner* — Michael E Gallion
(74) *Attorney, Agent, or Firm* — Daniel Zamudio

(57) ABSTRACT

A mandrel with a biasing assembly that extends the mandrel's life for turning of sheet materials. The mandrel's biasing assembly having a pivot, sleeve, cup and screw that connect a gripper to the arbor and works to alleviate the forces that can cause damage to such a winding machine.

5 Claims, 6 Drawing Sheets

(56) References Cited

U.S. PATENT DOCUMENTS

| | | | | | |
|---|---|---|---|---|---|
| 3,379,389 | A * | 4/1968 | O'Keefe | B21C 47/30 | 242/573.8 |
| 3,446,450 | A * | 5/1969 | Sherwood | B21C 47/30 | 242/573.8 |
| 3,815,839 | A * | 6/1974 | Madachy | B21C 47/30 | 242/571.1 |
| 3,840,197 | A * | 10/1974 | Rodach | B21C 47/323 | 242/573.8 |
| 4,078,739 | A * | 3/1978 | Noe | B65H 19/28 | 242/573.8 |
| 4,113,198 | A * | 9/1978 | Rodach | B65H 75/242 | 242/573.8 |
| 4,213,577 | A * | 7/1980 | Majoor | B21C 47/30 | 242/576.1 |
| 4,280,671 | A * | 7/1981 | Miller | B21C 1/14 | 242/573.8 |
| 4,421,283 | A * | 12/1983 | Rippin | B65H 75/242 | 242/529 |
| 7,975,956 | B2 * | 7/2011 | Denker | B21C 47/30 | 242/571.2 |

* cited by examiner

PIVOTING GRIPPER MANDREL

CROSS-REFERENCE TO RELATED APPLICATIONS

The present application claims the benefit of U.S. Provisional Patent Application No. 62/338,302, filed May 18, 2016, the entirety of which is hereby incorporated by reference.

BACKGROUND

The large scale manufacture of sheet material, tinplate, ferrous alloys, tantalum, or steel to name a few examples of sheet material, has been going on since the early 17th century. For example, one process involves making tin, which is extremely malleable, into sheets for making tin cans. The shear number of tin products made requires that tin be made into long sheets, rolled, then delivered in large rolls to the product manufacturers.

A mandrel is used for rolling such tinplate. The tin sheet is spun onto the mandrel. The spinning method requires clamping one end of the sheet, then spinning a mandrel so the sheet gets turned around the mandrel. The roll is then held internally by the mandrel parts, usually by an outward exertion of force, and the mandrel spins to add sheet material and increase the size of the roll.

In industry, it is desirable to wind the sheet into rolls at a rapid speed. High RPMs create pressure on the initial clamped end of the sheet. Additionally, the heavy nature of the sheet material tugs on the sheet and the mandrel while rolling. Great forces are exerted during the process of rolling steel, for example, onto a mandrel, including those caused by high speeds and heavy weight.

There is a need in the industry for an apparatus that is easy to use, inexpensive, and alleviates the strain from forces exerted when rolling or unrolling of sheet material, carbon steel or tinplate to name a few examples. A need for an apparatus suited to spinning sheets of a material, tinplate to name one example, at high speeds and minimizing the risk of broken machinery or danger from spinning material loosened from the apparatus.

SUMMARY

The present invention is directed to an apparatus that satisfies these needs. The apparatus comprises a pivot that is made from a durable material, metal for example. The pivot is instrumental in alleviating mechanical stresses introduced when rolling or unrolling metal sheets onto a mandrel. The pivot has at least two ears, protrusions. A sleeve that is made to have ear receiving ports. The pivot's ears will fit into these ports. The sleeve has a hole. The apparatus is configured such that the sleeve and the pivot are connected with the ears engaging with the ear receiving ports. A cup that allows the sleeve to be inserted into the cup. A screw passes through the hole and is threaded into the pivot. A mandrel is made with the cup being integrally attached to the mandrel. Often the cup is an insert that is pressed into the mandrel and secured by many different methods. The apparatus is part of a larger mandrel machine.

An embodiment of the apparatus is made up of an arbor which is a commonly known piece of machinery and is central and upon which a mandrel spins. The arbor has at least one first bore with its longitudinal axis being relatively perpendicular to an axis of the arbor around which the mandrel spins. The at least one first bore is threaded.

The apparatus embodiment has at least one pivot with protrusions called ears and a screw receiving portion which is threaded. There is at least one sleeve with an upper end which is threaded. The at least one sleeve having a lower end and having a plurality of ear receiving ports which are located at the lower end.

The at least one sleeve is best having a first hole that is situated at the upper end. The at least one sleeve and the at least one pivot being connected such that the ears are engaging with the ear receiving ports. The embodiment includes a gripper. The gripper is what actually is used to hold onto a metal sheet as the mandrel spins.

The gripper is made to have at least one second bore. The gripper being situated adjacently to the arbor such that a longitudinal axes of the at least one second bore is relatively aligned with the longitudinal axis of the at least one first bore together the axes being relatively perpendicular to the axis of the arbor.

There is at least one cup having a second hole. The at least one cup being located within the at least one second bore of the gripper. The at least one sleeve being inserted into the at least one first bore of the arbor. The lower end being situated proximately to the axis of the arbor, closest to the center of the mandrel. The upper end being threadably attached to the at least one first bore. The second hole being adjacent to the upper end.

There is a fastener, a screw for example, which passes through the second hole and the first hole. The screw being threadably connected to the threaded portion. The embodiment threads are best if made according a UNJ thread form (ASME B1.15) which is a system of threads which are particularly suited to applications where a high resistance to fatigue cracking is required. This choice is important because the parts are subjected to cyclic loading, where fatigue stress and cracking are the primary mode of failure, often at load levels significantly lower than the tensile or shear limits of the material. UNJ threads are the same as Unified Screw Threads per ASME/ANSI B1.1 with some exceptions, specifically that the root of the external thread has a maximum and minimum prescribed radius. This radius reduces the stress concentration effect caused by a sharp corner, increasing the fatigue life of the threaded part. The embodiment is a mandrel where the gripper is fastened to the arbor. It is best if much of the material making the fastener is a precipitation hardened stainless steel, or the like, that provides high strength and hardness, excellent fatigue properties, good corrosion resistance, good formability, and minimum distortion upon heat treatment. This special alloy provides benefits for applications requiring high strength and good corrosion resistance.

Another embodiment of the apparatus comprises a spinner that is used during installation. The sleeve having at least one hold, in the best mode the hold would be a shallow hole, where the spinner can engage and disengage. The spinner works to thread or dethread the sleeve from the arbor by exerting a force against the hold that translated to the sleeve. A bolt can be screwed into a pivot at the same time the spinner is manipulating the sleeve to prevent ears on the pivot from getting jammed due to the independent rotation of the sleeve.

The apparatus is useful to prevent breakage caused when rolling or unrolling metal sheets, during an industrial winding process. The device provides a unique joint, a biasing assembly, that assists in holding metal sheet on a mandrel.

The invention is an improvement to an expanding mandrel assembly. Such an assembly is useful, in one embodiment, for coiling strip stock such as tinplate into a roll. The improvement facilitates inserting a free end of the strip stock into the mandrel in a collapsed state, gripping the free end in the mandrel in an expanded state, and releasing the roll of strip stock (including the free end) after coiling is complete.

BRIEF DESCRIPTION OF THE SEVERAL VIEWS OF THE DRAWINGS

These and other features, aspects and advantages of the present invention will become better understood with regard to the following description, appended claims, and accompanying drawings where:

DESCRIPTION

Overview

Figure 1:
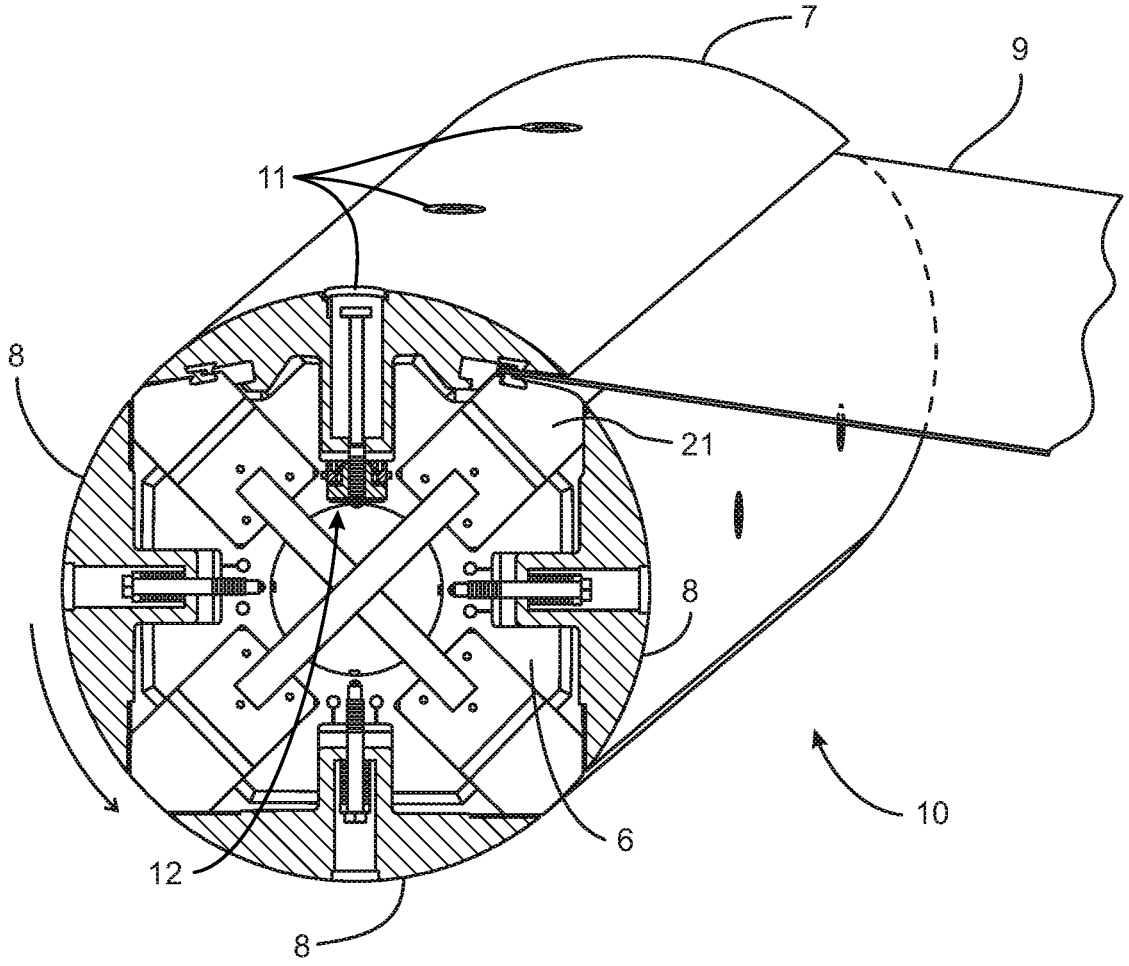
FIG. 1 is a perspective view of an embodiment of an improved mandrel with a sheet stock free end inserted in the gripper opening.
Figure 2:
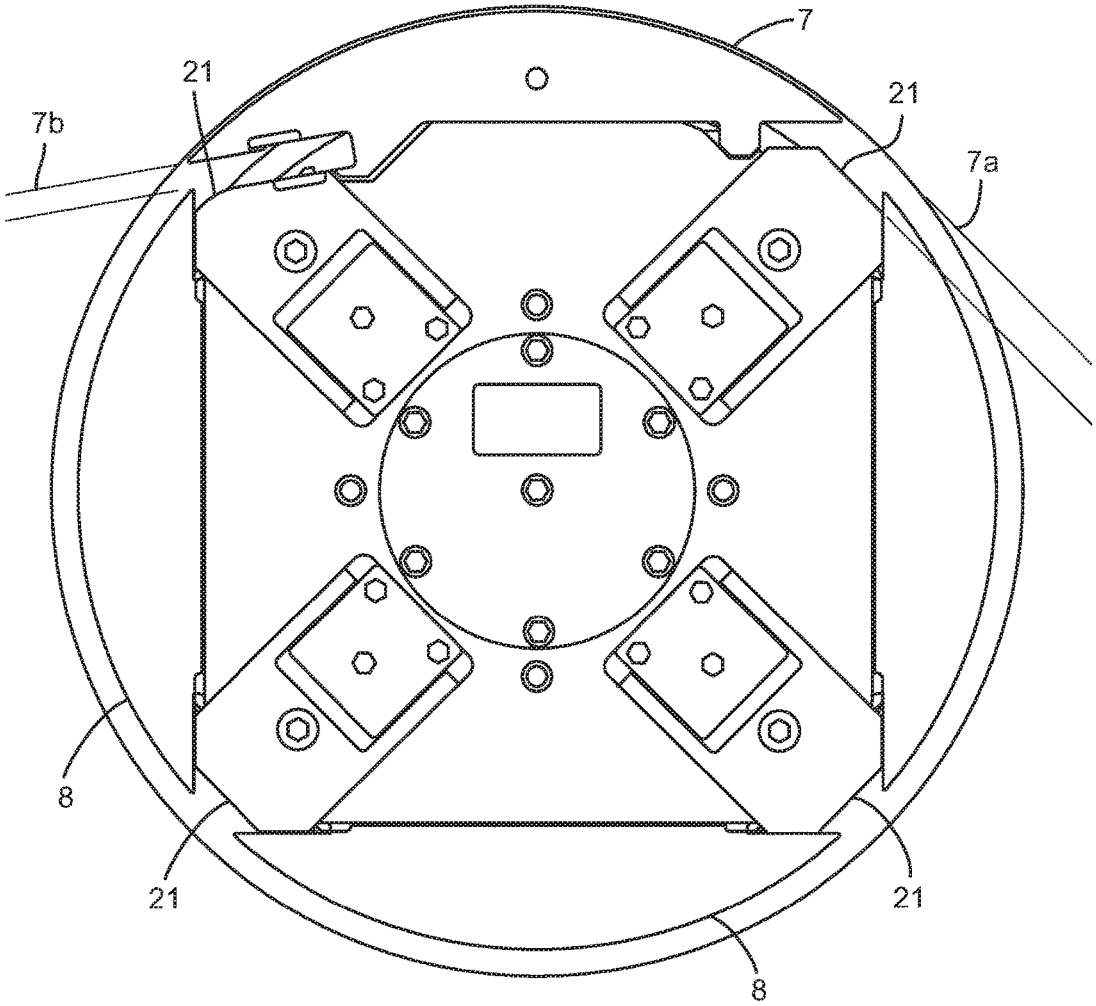
FIG. 2 is an end view of an embodiment of an improved mandrel in the collapsed state.

FIG. 1 shows an expanding mandrel assembly. The mandrel assembly 10 includes an arbor 6 with exterior segments forming a substantially cylindrical volume about which strip stock may be coiled. As shown in FIG. 1, the top exterior segment is a gripper segment 7, and the remaining exterior segments are expanding segments 8. The mandrel assembly 10 is useful for coiling strip stock into rolls that facilitate easy shipping and handling. In an embodiment, the expanding segments are moved between an expanded state and a collapsed state by internal components activated by a center-oriented drawbar (not shown). In an embodiment, the expanding segments 8 in the expanded state form a substantially cylindrical configuration with the gripper segment 7 attached via two cups 11 to the arbor 6. The expanding segments 8 in the collapsed state retract to within a reduced diameter below the perimeter of the gripper segment 7. In FIG. 1, a free end 9 of strip stock is shown inserted under an edge of the gripper segment 7, captured between the gripper segment 7 and an expander component 21. Referring now to FIG. 2, an end view along a centerline of a mandrel assembly 10 is shown.

In FIG. 2, the internal components (e.g., expanders 21) of the mandrel assembly are configured so that the expanding segment 7 is in the collapsed state and the gripper segment 7 defines a theoretical diameter 7*a* that is larger than the outermost surfaces of the expanding segments 8 shown in the collapsed state. Also visible in FIG. 2 is an opening 7*b* for inserting the free end of the sheet stock at the start of the coiling process. In another embodiment the gripper segment 7 expands or collapses along with the expanding segments 8.

In the embodiment shown, the expanders 21 are actuated by internal components to extend toward and retract from a centerline of the mandrel assembly 10 and to either push the expanding segments 8 outward from the centerline or to enable the expander's 21 to collapse inward toward the centerline. In the embodiment shown in FIG. 2, the expanding segments 8 are spring-loaded to be biased to collapse inward. Extending the expanders 21 pushes the expanding segments 8 outward by compressing the springs. When the expanders 21 collapse, the segments simply subside inwards as the springs expand to their previous configuration. In another embodiment, the expanding segments may be controlled by various other means and methods.

Figure 3:
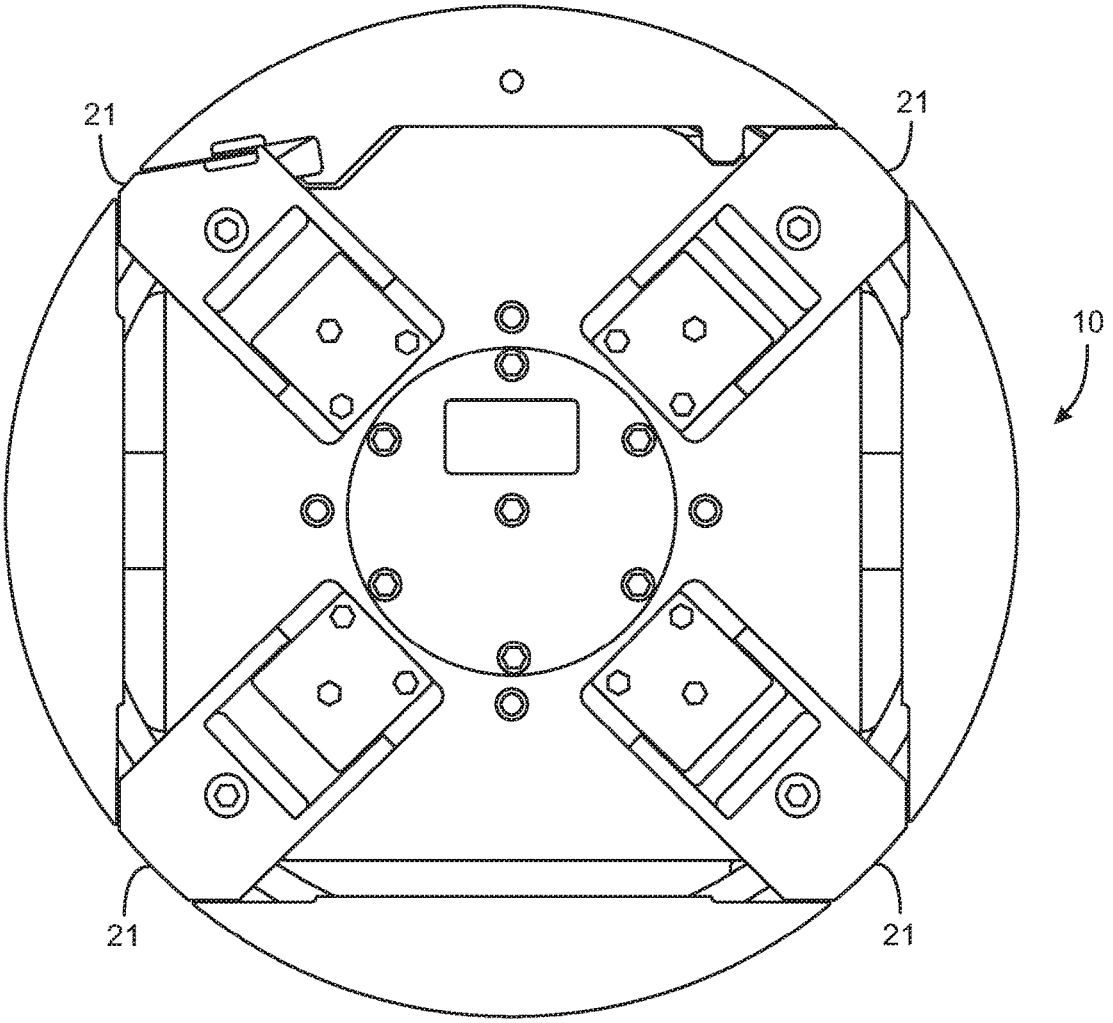
FIG. 3 is another end view of an embodiment of an improved mandrel in the expanded state.

Referring now to FIG. 3, another end view of the mandrel assembly 10 is shown. In FIG. 3, the expanders 21 are extended outward from the mandrel centerline, pushing the expanding segments 8 out to the diameter 7*b* to form a substantially complete cylindrical mandrel configuration. In FIG. 3, there is no strip stock free end inserted under the gripper segment.

Figure 4:
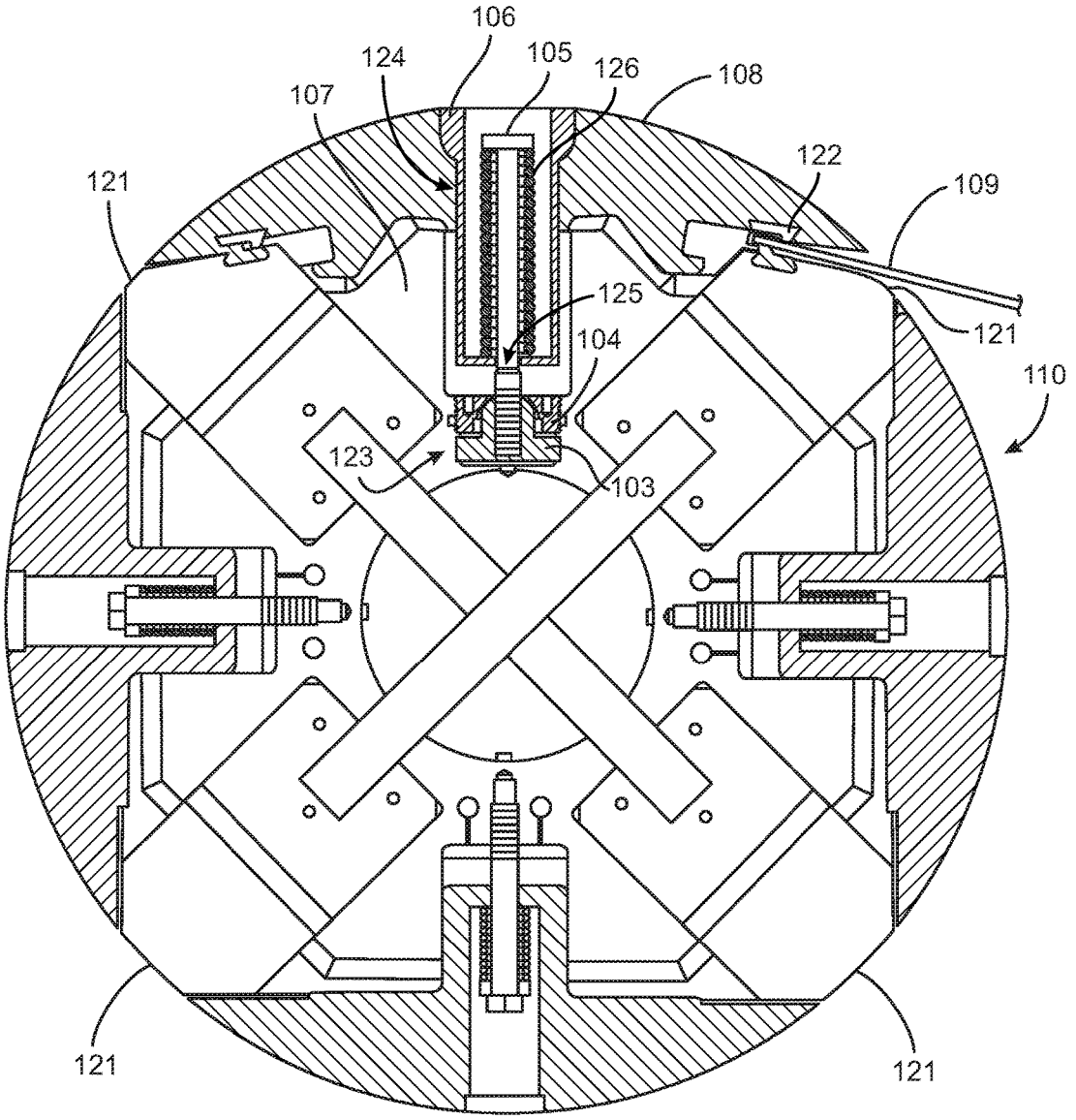
FIG. 4 is a section view of an embodiment of an improved mandrel in the expanded state.

Referring now to FIG. 4, a section view of a mandrel assembly 110 is shown. In FIG. 4, a strip stock free end is shown captured between a gripper segment 108 and one of the expanders 121. Also shown in FIG. 4 are mounting components that connect an embodiment of the gripper segment to the mandrel assembly 110.

In an embodiment, the gripper segment 108 is connected to the mandrel via one or more biasing assemblies, each biasing assembly including a cup 106, the cup 106 being located in a second bore 124, and a fastener 105 connected to a pivot 103. The pivot 103 is captured in a pocket in an arbor 107 by a sleeve 104 fixed to the arbor 107, the sleeve 104 being located in a first bore 123. In the embodiment of FIG. 4, the sleeve 104 is threaded into the arbor 107, but other embodiments may employ various connections between the arbor 107 and the sleeve 104. The fastener 105 passes through a second hole 125 of the cup 106 and a first hole 819 of FIG. 5 of the sleeve 104 before it screws into the pivot 103 and compresses a biasing component 126 that biases the cup 106 downward towards the sleeve 104 (i.e., in the direction of the mandrel assembly centerline). As shown in FIG. 4, the biasing component 126 is a compression spring. In another embodiment, the biasing component may comprise one or more conical spring washers, or the like, a resilient component, a combination thereof, or various means and methods of connection.

Also shown in FIG. 4, the strip stock free end 109 displaces the gripper segment outward due to the additional thickness of the free end 109 residing between the expander 121, or in another embodiment the arbor itself, and the gripper segment 108. The inclusion of the free end 109 causes the gripper segment to further compress the biasing component in order to accommodate the displacement. The inventive biasing assembly works to displace the various mechanical forces occurring when the free end 109 is held by the gripper segment 108.

Figure 5:
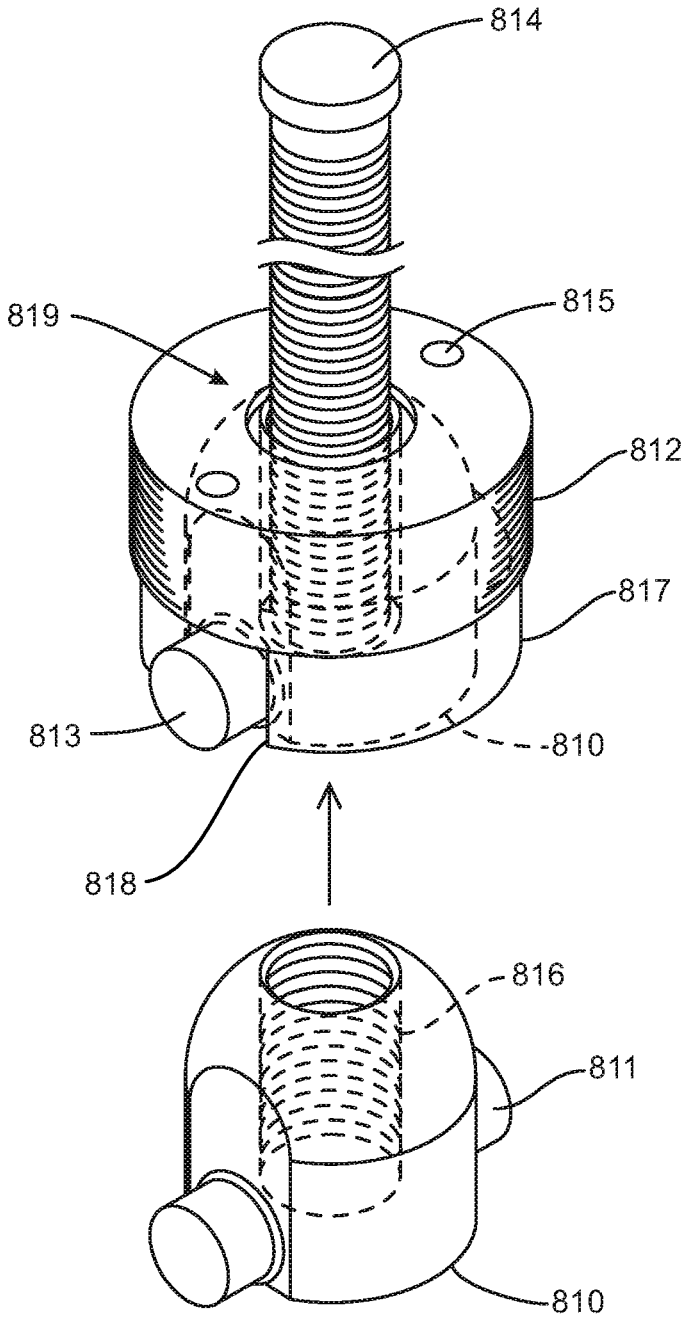
FIG. 5 shows a view of the pivot portion of the improved mandrel.

As shown in FIG. 5, the pivot portion of the improved mandrel comprises a bolt 814. The bolt 814 passes through a hole 819 in a sleeve 817. Fitted into the underside of the sleeve 817 is a turn 810 (being equivalent to 103 in FIG. 1) having a spherical dome 820. The turn 810 having at least one ear 813, 811. The ears 813, 811 each fitting into at least one slot 818 on the sleeve 817. The turn 810 having a threaded portion 816 that engages with the bolt 814. The sleeve 817 having a second threaded portion 812 that is used to fasten the sleeve 817 to the arbor 7 of FIG. 1. The sleeve 817 having at least one depression 815 to receive a tool (not shown) for engaging the sleeve 817 with the arbor 7 of FIG. 1.

Figure 6:
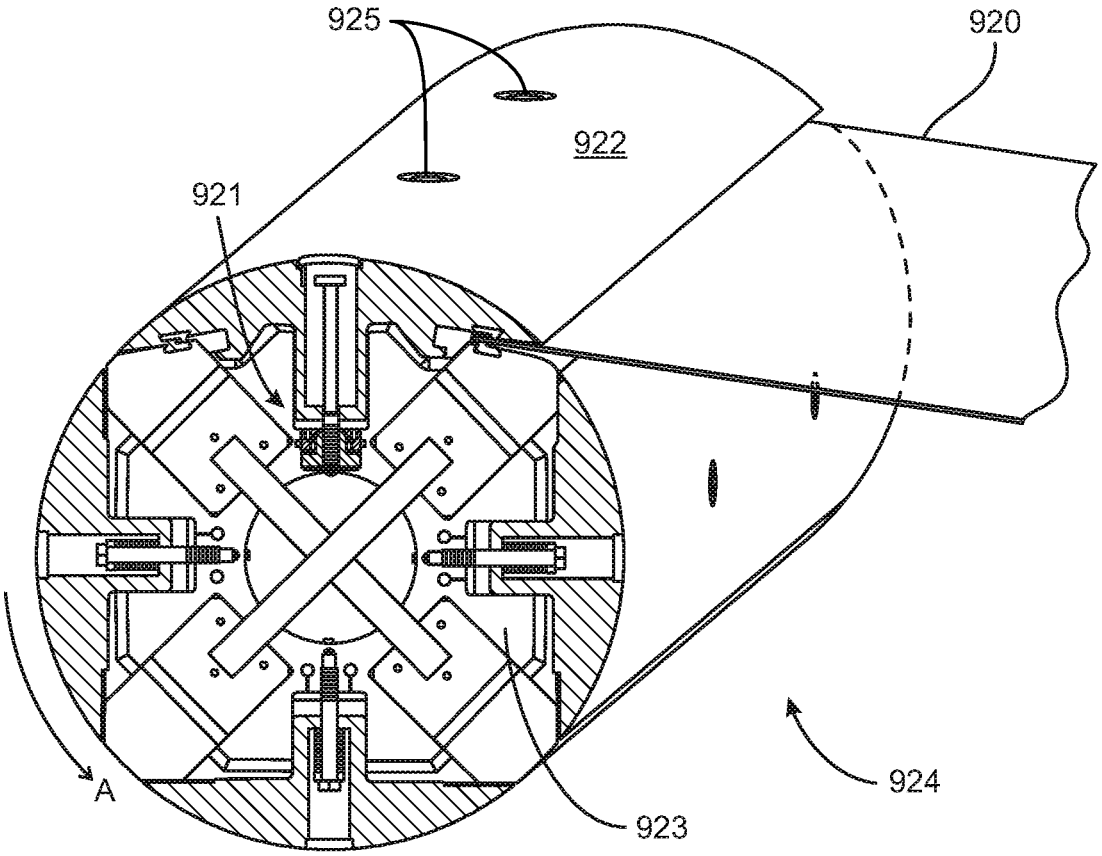
FIG. 6 shows a view of another embodiment of the mandrel with a cutaway, the mandrel shown rolling a metal sheet.

As shown in FIG. 6, another embodiment of the mandrel with a cutaway, the mandrel shown rolling a metal sheet comprises a mandrel 924 having at least one turn 921 located in at least one cup 925. The at least one turn 921 attaching at least one gripper 922 to an arbor 923. The gripper 922 holds onto a workpiece 920 that is sheet material. When the mandrel is spun in the direction A at high speeds the workpiece 920 is wound around the mandrel 924.

In another embodiment, the pivot 103 comprises a spherical dome seated against the sleeve 104, and the spherical pivot enables the gripper segment to rotate slightly—to tilt away from the captured free end—thereby accommodating the additional thickness of the free end 109.

Although the present invention has been described in considerable detail with the reference to certain preferred versions thereof, other versions are possible. For example, the mandrel can be used for unrolling just as easily as it can be used for rolling tin sheets; or the depression that receives the spinner can be a protrusion or any other means for being grasped to manipulate the sleeve. The spirit of the invention is to provide a mandrel that has parts to alleviate the various forces exerted on a mandrel, such as those exerted at a gripping segment, when it is used to roll or unroll sheets, such as tinplate. Therefore, the spirit and scope of the appended claims should not be limited to the description of the preferred versions contained herein.

Any element in a claim that does not explicitly state "means for" performing a specified function, or "step for" performing a specific function, is not to be interpreted as a "means" or "step" clause as specified in 35 U.S.C. § 112, ¶ 6. In particular, the use of "step of" in the claims herein is not intended to invoke the provisions of 35 U.S.C. § 112, ¶ 6.

What I claim is:

1. An apparatus comprising:

an arbor;

the arbor having at least one first bore;

a longitudinal axis of the at least one first bore being substantially perpendicular to an axis of the arbor;

the at least one first bore being threaded;

at least one pivot;

the at least one pivot having ears;

the at least one pivot having a threaded portion;

the threaded portion being threaded;

at least one sleeve;

the at least one sleeve having an upper end;

the upper portion being threaded;

the at least one sleeve having a lower end;

the at least one sleeve having a plurality of ear receiving ports;

the plurality of ear receiving ports located at the lower end;

the at least one sleeve having a first hole;

the first hole situated at the upper end;

the at least one sleeve and the at least one pivot being connected such that the ears are engaging with the ear receiving ports;

a gripper;

the gripper having at least one second bore;

the gripper being situated adjacently to the arbor such that a longitudinal axes of the at least one second bore is substantially aligned with the longitudinal axis of the at least one first bore together the axes being relatively perpendicular to the axis of the arbor;

at least one cup;

the at least one cup having a second hole;

the at least one cup being located within the at least one second bore;

the at least one sleeve being inserted into the at least one first bore;

the lower end being situated proximately to the axis of the arbor;

the upper end being threadably attached to the one first bore;

the second hole being adjacent to the upper end;

a fastener;

the fastener passing through the second hole;

the fastener passing through the first hole;

the fastener being threadably connected to the threaded portion.

2. The apparatus of claim 1 wherein the pivot provides a joint upon which movement of the gripper can be translated.

3. A gripper assembly for an expanding mandrel, the mandrel including expanding segments around a periphery, the gripper assembly comprising:

a gripper segment mounted to a central arbor of the mandrel via a plurality of cups disposed in the gripper segment along a longitudinal line, each cup extending substantially from a gripper outer surface towards a mandrel centerline;

a plurality of threaded sleeves engaging threaded holes in the arbor corresponding to the plurality of cups, each threaded sleeve capturing a domed pivot within a pocket in the central arbor underneath the threaded sleeve, the domed pivot being seated in the threaded sleeve;

a plurality of fasteners, each fastener extending through a respective cup and threaded sleeve to connect to a respective pivot;

a plurality of biasing components, each biasing component captured between a respective fastener and cup, each biasing component biasing the respective cup and the gripper towards the respective threaded sleeve; and wherein the expanding segments move between an extended and a collapsed position, at least one expanding segment in the extended position clamping a free end of strip stock between the expanding segment and the gripper, and the gripper being enabled to shift via compression of the biasing component with respect to the arbor to accommodate the clamped free end.

4. An expanding mandrel comprising:

a central arbor;

a plurality of expanding segments forming a portion of an outer periphery of the mandrel, the expanding segments moving between an extended position along a larger diameter of the mandrel and a collapsed position along a smaller diameter of the mandrel;

a gripper segment forming a remaining portion of the outer periphery along the larger diameter;

a plurality of threaded sleeves set into the gripper segment, each threaded sleeve engaging threaded holes in the arbor, each threaded sleeve capturing a domed pivot within a pocket underneath the threaded sleeve, the domed pivot being seated in a circular hole through the threaded sleeve;

a plurality of fasteners, each fastener extending through a respective cup and threaded sleeve to connect to a respective pivot;

a plurality of biasing components, each biasing component captured between a respective fastener and cup, each biasing component biasing the respective cup and the gripper towards the respective threaded sleeve; and wherein the expanding segments move between an extended and a collapsed position, at least one expanding segment in the extended position clamping a free end of strip stock between the expanding segment and the gripper segment, and the gripper segment pivoting on the plurality of pivots to accommodate the clamped free end.

5. A mandrel comprising:

an arbor;

the arbor having at least one first bore;

a longitudinal axis of the at least one first bore being substantially perpendicular to an axis of the arbor;

the at least one first bore being threaded;

at least one turn;

the at least turn having a plurality of ears;

the at least one turn having a threaded portion;

at least one sleeve;

the at least one sleeve having a first hole;

the at least one sleeve having a second threaded portion;

the at least one sleeve having a plurality of slots located at one end of the at least one sleeve;

the ears fitting into the slots;

a gripper segment;

the gripper segment having at least one second bore;

the gripper segment being situated adjacently to the arbor such that a longitudinal axes of the at least one second bore is substantially aligned with the longitudinal axis of the at least one first bore together the axes being substantially perpendicular to the axis of the arbor;

at least one cup;

the at least one cup having a second hole;

the at least one cup being located within the at least one second bore;

the at least one sleeve being inserted into the at least one first bore;

the turn being situated proximately to the axis of the arbor;

the second threaded portion being threadably attached to the at least one first bore;

a bolt passing through the first and the second holes and being threadably attached to the threaded portion;

a compression spring captured between the bolt and the cup.

* * * * *